US010319313B2

(12) United States Patent
Harris et al.

(10) Patent No.: US 10,319,313 B2
(45) Date of Patent: Jun. 11, 2019

(54) METHODS FOR DRIVING VIDEO ELECTRO-OPTIC DISPLAYS

(75) Inventors: George G. Harris, Woburn, MA (US); Shamus Ford Patry, Worcester, MA (US); Michael D. McCreary, Acton, MA (US)

(73) Assignee: E Ink Corporation, Billerica, MA (US)

( * ) Notice: Subject to any disclaimer, the term of this patent is extended or adjusted under 35 U.S.C. 154(b) by 664 days.

(21) Appl. No.: 12/124,462

(22) Filed: May 21, 2008

(65) Prior Publication Data

US 2008/0291129 A1 Nov. 27, 2008

Related U.S. Application Data

(60) Provisional application No. 60/939,187, filed on May 21, 2007.

(51) Int. Cl.

| | |
|---|---|
| ***G09G 3/28*** | (2013.01) |
| ***G09G 3/34*** | (2006.01) |
| ***G09G 3/20*** | (2006.01) |

(52) U.S. Cl.

CPC ..... *G09G 3/344* (2013.01); *G09G 3/2011* (2013.01); *G09G 2310/02* (2013.01); *G09G 2310/0216* (2013.01); *G09G 2320/0247* (2013.01); *G09G 2340/0435* (2013.01); *G09G 2340/16* (2013.01)

(58) Field of Classification Search

USPC ..... 345/87–104, 107, 204–690

See application file for complete search history.

(56) References Cited

U.S. PATENT DOCUMENTS

| | | | |
|---|---|---|---|
| 4,418,346 | A | 11/1983 | Batchelder |
| 5,760,761 | A | 6/1998 | Sheridon |
| 5,777,782 | A | 7/1998 | Sheridon |
| 5,808,783 | A | 9/1998 | Crowley |
| 5,872,552 | A | 2/1999 | Gordon, II et al. |
| 5,930,026 | A | 7/1999 | Jacobson et al. |
| 5,961,804 | A | 10/1999 | Jacobson et al. |
| 6,017,584 | A | 1/2000 | Albert et al. |
| 6,054,071 | A | 4/2000 | Mikkelsen, Jr. |
| 6,055,091 | A | 4/2000 | Sheridon et al. |

(Continued)

FOREIGN PATENT DOCUMENTS

| | | |
|---|---|---|
| JP | 2004102055 | 4/2004 |
| JP | 2004157450 | 6/2004 |

(Continued)

OTHER PUBLICATIONS

Hayes, R.A., et al., "Video-Speed Electronic Paper Based on Electrowetting", Nature, vol. 425, Sep. 25, pp. 383-385 (2003).

(Continued)

*Primary Examiner* — Van N Chow
*Assistant Examiner* — Jeffrey S Steinberg
(74) *Attorney, Agent, or Firm* — Zhen Bao

(57) ABSTRACT

Video displays using relatively low frame rates of about 10 to about 20 frames per second, but having acceptable video quality are described. The displays may use bistable media, and may be driven such that the medium, when driven, changes its optical properties continuously during the driving of each frame. The displays may use an electro-optic medium such that the frame period is from about 50 to about 200 per cent of the switching time of the electro-optic medium at the driving voltage used.

7 Claims, 1 Drawing Sheet

(56) References Cited

U.S. PATENT DOCUMENTS 6,067,185 A 5/2000 Albert et al.
6,097,531 A 8/2000 Sheridon
6,118,426 A 9/2000 Albert et al.
6,120,588 A 9/2000 Jacobson
6,120,839 A 9/2000 Comiskey et al.
6,124,851 A 9/2000 Jacobson
6,128,124 A 10/2000 Silverman
6,130,773 A 10/2000 Jacobson et al.
6,130,774 A 10/2000 Albert et al.
6,137,467 A 10/2000 Sheridon et al.
6,144,361 A 11/2000 Gordon, II et al.
6,147,791 A 11/2000 Sheridon
6,172,798 B1 1/2001 Albert et al.
6,177,921 B1 1/2001 Comiskey et al.
6,184,856 B1 2/2001 Gordon, II et al.
6,225,971 B1 5/2001 Gordon, II et al.
6,232,950 B1 5/2001 Albert et al.
6,249,271 B1 6/2001 Albert et al.
6,252,564 B1 6/2001 Albert et al.
6,262,706 B1 7/2001 Albert et al.
6,262,833 B1 7/2001 Loxley et al.
6,271,823 B1 8/2001 Gordon, II et al.
6,300,932 B1 10/2001 Albert
6,301,038 B1 10/2001 Fitzmaurice et al.
6,312,304 B1 11/2001 Duthaler et al.
6,312,971 B1 11/2001 Amundson et al.
6,323,989 B1 11/2001 Jacobson et al.
6,327,072 B1 12/2001 Comiskey et al.
6,362,915 B1 * 3/2002 Sheridon ..... G09F 9/372 264/15
6,376,828 B1 4/2002 Comiskey
6,377,387 B1 4/2002 Duthaler et al.
6,392,785 B1 5/2002 Albert et al.
6,392,786 B1 5/2002 Albert
6,413,790 B1 7/2002 Duthaler et al.
6,422,687 B1 7/2002 Jacobson
6,445,374 B2 9/2002 Albert et al.
6,445,489 B1 9/2002 Jacobson et al.
6,459,418 B1 10/2002 Comiskey et al.
6,473,072 B1 * 10/2002 Comiskey et al. ..... 345/173
6,480,182 B2 11/2002 Turner et al.
6,498,114 B1 12/2002 Amundson et al.
6,504,524 B1 1/2003 Gates et al.
6,506,438 B2 1/2003 Duthaler et al.
6,512,354 B2 1/2003 Jacobson et al.
6,515,649 B1 2/2003 Albert et al.
6,518,949 B2 2/2003 Drzaic
6,521,489 B2 2/2003 Duthaler et al.
6,531,997 B1 3/2003 Gates et al.
6,535,197 B1 3/2003 Comiskey et al.
6,538,801 B2 3/2003 Jacobson et al.
6,545,291 B1 4/2003 Amundson et al.
6,580,545 B2 6/2003 Morrison et al.
6,593,985 B1 * 7/2003 Taira et al. ..... 349/119
6,639,578 B1 10/2003 Comiskey et al.
6,650,462 B2 11/2003 Katase
6,652,075 B2 11/2003 Jacobson
6,657,772 B2 12/2003 Loxley
6,664,944 B1 12/2003 Albert et al.
6,672,921 B1 1/2004 Liang et al.
6,680,725 B1 1/2004 Jacobson
6,683,333 B2 1/2004 Kazlas et al.
6,704,133 B2 3/2004 Gates et al.
6,710,540 B1 3/2004 Albert et al.
6,721,083 B2 4/2004 Jacobson et al.
6,724,519 B1 4/2004 Comiskey et al.
6,727,881 B1 4/2004 Albert et al.
6,738,050 B2 5/2004 Comiskey et al.
6,745,155 B1 * 6/2004 Andringa ..... G01R 23/175 381/58
6,750,473 B2 6/2004 Amundson et al.
6,753,999 B2 6/2004 Zehner et al.
6,762,744 B2 7/2004 Katase
6,788,449 B2 9/2004 Liang et al.
6,816,147 B2 11/2004 Albert
6,819,471 B2 11/2004 Amundson et al.
6,822,782 B2 11/2004 Honeyman et al.
6,825,068 B2 11/2004 Denis et al.
6,825,829 B1 11/2004 Albert et al.
6,825,970 B2 11/2004 Goenaga et al.
6,831,769 B2 12/2004 Holman et al.
6,839,158 B2 1/2005 Albert et al.
6,842,167 B2 1/2005 Albert et al.
6,842,279 B2 1/2005 Amundson
6,842,657 B1 1/2005 Drzaic et al.
6,864,875 B2 3/2005 Drzaic et al.
6,865,010 B2 3/2005 Duthaler et al.
6,866,760 B2 3/2005 Paolini, Jr. et al.
6,870,657 B1 3/2005 Fitzmaurice et al.
6,870,661 B2 3/2005 Pullen et al.
6,900,851 B2 5/2005 Morrison et al.
6,922,276 B2 7/2005 Zhang et al.
6,940,497 B2 * 9/2005 Vincent et al. ..... 345/204
6,950,220 B2 9/2005 Abramson et al.
6,958,848 B2 10/2005 Cao et al.
6,961,047 B2 11/2005 Katase
6,965,366 B2 11/2005 Ozawa
6,967,640 B2 11/2005 Albert et al.
6,982,178 B2 1/2006 LeCain et al.
6,987,603 B2 1/2006 Paolini, Jr. et al.
6,995,550 B2 2/2006 Jacobson et al.
7,002,728 B2 2/2006 Pullen et al.
7,012,600 B2 3/2006 Zehner et al.
7,012,735 B2 3/2006 Honeyman et al.
7,023,420 B2 4/2006 Comiskey et al.
7,030,412 B1 4/2006 Drzaic et al.
7,030,854 B2 4/2006 Baucom et al.
7,034,783 B2 4/2006 Gates et al.
7,038,655 B2 5/2006 Herb et al.
7,061,663 B2 6/2006 Cao et al.
7,071,913 B2 7/2006 Albert et al.
7,075,502 B1 7/2006 Drzaic et al.
7,075,703 B2 7/2006 O'Neil et al.
7,079,305 B2 7/2006 Paolini, Jr. et al.
7,106,296 B1 9/2006 Jacobson
7,109,968 B2 9/2006 Albert et al.
7,110,163 B2 9/2006 Webber et al.
7,110,164 B2 9/2006 Paolini, Jr. et al.
7,116,318 B2 10/2006 Amundson et al.
7,116,466 B2 10/2006 Whitesides et al.
7,119,759 B2 10/2006 Zehner et al.
7,119,772 B2 10/2006 Amundson et al.
7,123,246 B2 10/2006 Nakatani et al.
7,145,547 B2 12/2006 Johnson
7,148,128 B2 12/2006 Jacobson
7,167,155 B1 1/2007 Albert et al.
7,170,670 B2 1/2007 Webber
7,173,752 B2 2/2007 Doshi et al.
7,176,880 B2 2/2007 Amundson et al.
7,180,554 B2 * 2/2007 Divelbiss et al. ..... 348/742
7,180,649 B2 2/2007 Morrison et al.
7,190,008 B2 3/2007 Amundson et al.
7,193,625 B2 3/2007 Danner et al.
7,202,847 B2 4/2007 Gates
7,202,991 B2 4/2007 Zhang et al.
7,206,119 B2 4/2007 Honeyman et al.
7,223,672 B2 5/2007 Kazlas et al.
7,230,604 B2 6/2007 Machida
7,230,750 B2 6/2007 Whitesides et al.
7,230,751 B2 6/2007 Whitesides et al.
7,236,291 B2 6/2007 Kaga et al.
7,242,513 B2 7/2007 Albert et al.
7,247,379 B2 7/2007 Pullen et al.
7,256,766 B2 8/2007 Albert et al.
7,259,744 B2 8/2007 Arango et al.
7,279,641 B2 10/2007 Shikina
7,280,094 B2 10/2007 Albert
7,304,634 B2 12/2007 Albert et al.
7,304,787 B2 12/2007 Whitesides et al.
7,312,784 B2 12/2007 Baucom et al.
7,312,794 B2 12/2007 Zehner et al.
7,312,916 B2 12/2007 Pullen et al.
7,321,459 B2 1/2008 Masuda et al.
7,327,511 B2 2/2008 Whitesides et al.

(56) References Cited

U.S. PATENT DOCUMENTS 7,339,715 B2 3/2008 Webber et al.
7,349,148 B2 3/2008 Doshi et al.
7,352,353 B2 4/2008 Albert et al.
7,365,394 B2 4/2008 Denis et al.
7,365,733 B2 4/2008 Duthaler et al.
7,369,299 B2 5/2008 Sakurai et al.
7,375,875 B2 5/2008 Whitesides et al.
7,382,363 B2 6/2008 Albert et al.
7,388,572 B2 6/2008 Duthaler et al.
7,391,555 B2 6/2008 Albert et al.
7,411,719 B2 8/2008 Paolini, Jr. et al.
7,411,720 B2 8/2008 Honeyman et al.
7,420,549 B2 9/2008 Jacobson et al.
7,442,587 B2 10/2008 Amundson et al.
7,443,571 B2 10/2008 LeCain et al.
7,453,445 B2 11/2008 Amundson
7,477,444 B2 1/2009 Cao et al.
7,492,339 B2 2/2009 Amundson
7,492,497 B2 2/2009 Paolini, Jr. et al.
7,528,822 B2 5/2009 Amundson et al.
7,532,388 B2 5/2009 Whitesides et al.
7,535,624 B2 5/2009 Amundson et al.
7,545,358 B2 6/2009 Gates et al.
7,551,346 B2 6/2009 Fazel et al.
7,554,712 B2 6/2009 Patry et al.
7,561,324 B2 7/2009 Duthaler et al.
7,583,427 B2 9/2009 Danner et al.
7,598,173 B2 10/2009 Ritenour et al.
7,602,374 B2 10/2009 Zehner et al.
7,605,799 B2 10/2009 Amundson et al.
7,605,899 B2 10/2009 Shakina et al.
7,636,191 B2 12/2009 Duthaler
7,649,674 B2 1/2010 Danner et al.
7,667,684 B2 2/2010 Jacobson et al.
7,672,040 B2 3/2010 Sohn et al.
7,679,599 B2 3/2010 Kawai
7,679,814 B2 3/2010 Paolini et al.
7,688,297 B2 3/2010 Zehner et al.
7,705,823 B2 4/2010 Nihei et al.
7,705,824 B2 4/2010 Baucom et al.
7,728,811 B2 6/2010 Albert et al.
7,733,311 B2 * 6/2010 Amundson ..... G02F 1/167 345/101
7,733,335 B2 6/2010 Zehner et al.
7,733,554 B2 6/2010 Danner et al.
7,787,169 B2 8/2010 Abramson et al.
7,796,115 B2 * 9/2010 Zhou et al. ..... 345/107
7,812,812 B2 10/2010 Yoshinaga et al.
7,839,564 B2 11/2010 Whitesides et al.
7,843,621 B2 11/2010 Danner et al.
7,859,637 B2 12/2010 Amundson et al.
7,893,435 B2 2/2011 Kazlas et al.
7,903,319 B2 3/2011 Honeyman et al.
7,910,175 B2 3/2011 Webber et al.
7,952,557 B2 5/2011 Amundson et al.
7,952,790 B2 5/2011 Honeyman et al.
7,999,787 B2 8/2011 Amundson et al.
8,009,348 B2 8/2011 Zehner et al.
8,018,640 B2 9/2011 Whitesides et al.
8,035,886 B2 10/2011 Jacobson
8,064,962 B2 11/2011 Wilcox et al.
8,115,729 B2 2/2012 Danner et al.
8,125,501 B2 2/2012 Amundson et al.
8,129,655 B2 3/2012 Jacobson et al.
8,139,050 B2 3/2012 Jacobson et al.
2002/0060321 A1 5/2002 Kazlas et al.
2002/0090980 A1 7/2002 Wilcox et al.
2003/0020699 A1 * 1/2003 Nakatani et al. ..... 345/204
2003/0102858 A1 6/2003 Jacobson et al.
2004/0105036 A1 6/2004 Danner et al.
2004/0119681 A1 6/2004 Albert et al.
2004/0263947 A1 12/2004 Drzaic et al.
2005/0012980 A1 1/2005 Wilcox et al.
2005/0018273 A1 1/2005 Honeyman et al.
2005/0024353 A1 * 2/2005 Amundson et al. ..... 345/204
2005/0099549 A1 * 5/2005 Chen et al. ..... 349/41
2005/0122284 A1 6/2005 Gates et al.
2005/0122306 A1 6/2005 Wilcox et al.
2005/0122563 A1 6/2005 Honeyman et al.
2005/0156340 A1 7/2005 Valianatos et al.
2005/0179642 A1 * 8/2005 Wilcox ..... G09G 3/34 345/107
2005/0253777 A1 11/2005 Zehner et al.
2005/0259068 A1 11/2005 Nihei et al.
2006/0066503 A1 * 3/2006 Sampsell et al. ..... 345/1.1
2006/0087479 A1 4/2006 Sakurai et al.
2006/0087489 A1 4/2006 Sakurai et al.
2006/0087718 A1 4/2006 Takagi et al.
2006/0181504 A1 8/2006 Kawai
2006/0192751 A1 * 8/2006 Miyasaka ..... G09G 3/344 345/107
2006/0209008 A1 9/2006 Nihei et al.
2006/0214906 A1 9/2006 Kobayashi et al.
2006/0231401 A1 10/2006 Sakurai et al.
2006/0238488 A1 * 10/2006 Nihei et al. ..... 345/107
2007/0052757 A1 3/2007 Jacobson
2007/0063939 A1 * 3/2007 Bellamy ..... 345/87
2007/0070006 A1 * 3/2007 Katayama ..... G09G 3/3659 345/88
2007/0080920 A1 * 4/2007 Hosaka et al. ..... 345/98
2007/0091417 A1 4/2007 Cao et al.
2007/0091418 A1 4/2007 Danner et al.
2007/0109219 A1 * 5/2007 Whitesides et al. ..... 345/55
2007/0211002 A1 9/2007 Zehner et al.
2007/0285385 A1 12/2007 Albert et al.
2008/0024429 A1 1/2008 Zehner
2008/0024482 A1 1/2008 Gates et al.
2008/0043318 A1 2/2008 Whitesides et al.
2008/0048969 A1 2/2008 Whitesides et al.
2008/0048970 A1 2/2008 Drzaic et al.
2008/0054879 A1 3/2008 LeCain et al.
2008/0291129 A1 * 11/2008 Harris ..... G09G 3/2011 345/60
2011/0267333 A1 * 11/2011 Sakamoto ..... G09G 3/344 345/211

FOREIGN PATENT DOCUMENTS

JP 2004-317624 11/2004
JP 2005189851 7/2005
WO 2004107031 12/2004

OTHER PUBLICATIONS

Kitamura, T., et al., "Electrical toner movement for electronic paper-like display", Asia Display/IDW '01, p. 1517, Paper HCS1-1 (2001).

Yamaguchi, Y., et al., "Toner display using insulative particles charged triboelectrically", Asia Display/IDW '01, p. 1729, Paper AMD4-4 (2001).

United States Patent and Trademark Office; PCT/US2008/064327; International Search Report and Written Opinion; dated Aug. 8, 2008.

European Patent Office; EP 08756026.4; Extended European Search Report; dated Aug. 24, 2010.

* cited by examiner

METHODS FOR DRIVING VIDEO ELECTRO-OPTIC DISPLAYS

REFERENCE TO RELATED APPLICATIONS

This application claims benefit of Application Ser. No. 60/939,187, filed May 21, 2007.

This application is also related to:

(a) U.S. Pat. No. 6,504,524;
(b) U.S. Pat. No. 6,512,354;
(c) U.S. Pat. No. 6,531,997;
(d) U.S. Pat. No. 6,995,550;
(e) U.S. Pat. Nos. 7,012,600; 7,312,794; 7,688,297; and 7,733,335;
(f) U.S. Pat. No. 7,034,783;
(g) U.S. Pat. No. 7,119,772;
(h) U.S. Pat. No. 7,193,625;
(i) U.S. Pat. No. 7,259,744;
(j) copending application Ser. No. 10/879,335 (Publication No. 2005/0024353, now U.S. Pat. No. 7,528,822);
(k) copending application Ser. No. 10/904,707 (Publication No. 2005/0179642);
(l) copending application Ser. No. 10/906,985 (Publication No. 2005/0212747, now U.S. Pat. No. 7,492,339);
(m) U.S. Pat. No. 7,327,511;
(n) copending application Ser. No. 10/907,171 (Publication No. 2005/0152018, now U.S. Pat. No. 7,787,169);
(o) copending application Ser. No. 11/161,715 (Publication No. 2005/0280626, now U.S. Pat. No. 7,952,557);
(p) copending application Ser. No. 11/162,188 (Publication No. 2006/0038772, now U.S. Pat. No. 7,999,787);
(q) copending application Ser. No. 11/461,084 (Publication No. 2006/0262060, now U.S. Pat. No. 7,453,445);
(r) copending application Ser. No. 11/751,879 (Publication No. 2008/0024482);
(s) copending application Ser. No. 11/845,919 (Publication No. 2008/0048969);
(t) copending application Ser. No. 11/949,316, filed Dec. 3, 2007 (Publication No. 2008/0136774); and
(u) copending application Ser. No. 11/936,326, filed Nov. 7, 2007 (Publication No. 2008/0129667).

The entire contents of these copending applications, and of all other U.S. patents and published and copending applications mentioned below, are herein incorporated by reference.

BACKGROUND OF INVENTION

The present invention relates to methods for driving video electro-optic displays, especially bistable electro-optic displays, and to apparatus for use in such methods. More specifically, this invention relates to driving methods for video displays. This invention is especially, but not exclusively, intended for use with particle-based electrophoretic displays in which one or more types of electrically charged particles are present in a fluid and are moved through the fluid under the influence of an electric field to change the appearance of the display.

The term "electro-optic", as applied to a material or a display, is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The term "gray state" is used herein in its conventional meaning in the imaging art to refer to a state intermediate two extreme optical states of a pixel, and does not necessarily imply a black-white transition between these two extreme states. For example, several of the E Ink patents and published applications referred to below describe electrophoretic displays in which the extreme states are white and deep blue, so that an intermediate "gray state" would actually be pale blue. Indeed, as already mentioned, the change in optical state may not be a color change at all. The terms "black" and "white" may be used hereinafter to refer to the two extreme optical states of a display, and should be understood as normally including extreme optical states which are not strictly black and white, for example the aforementioned white and dark blue states. The term "monochrome" may be used hereinafter to denote a drive scheme which only drives pixels to their two extreme optical states with no intervening gray states.

The terms "bistable" and "bistability" are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in U.S. Pat. No. 7,170,670 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

The term "impulse" is used herein in its conventional meaning of the integral of voltage with respect to time. However, some bistable electro-optic media act as charge transducers, and with such media an alternative definition of impulse, namely the integral of current over time (which is equal to the total charge applied) may be used. The appropriate definition of impulse should be used, depending on whether the medium acts as a voltage-time impulse transducer or a charge impulse transducer.

Much of the discussion below will focus on methods for driving one or more pixels of an electro-optic display through a transition from an initial gray level to a final gray level (which may or may not be different from the initial gray level). The term "waveform" will be used to denote the entire voltage against time curve used to effect the transition from one specific initial gray level to a specific final gray level. Typically such a waveform will comprise a plurality of waveform elements; where these elements are essentially rectangular (i.e., where a given element comprises application of a constant voltage for a period of time); the elements may be called "pulses" or "drive pulses". The term "drive scheme" denotes a set of waveforms sufficient to effect all possible transitions between gray levels for a specific display.

Several types of electro-optic displays are known. One type of electro-optic display is a rotating bichromal member type as described, for example, in U.S. Pat. Nos. 5,808,783; 5,777,782; 5,760,761; 6,054,071 6,055,091; 6,097,531;

6,128,124; 6,137,467; and 6,147,791 (although this type of display is often referred to as a "rotating bichromal ball" display, the term "rotating bichromal member" is preferred as more accurate since in some of the patents mentioned above the rotating members are not spherical). Such a display uses a large number of small bodies (typically spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed by applying an electric field thereto, thus rotating the bodies to various positions and varying which of the sections of the bodies is seen through a viewing surface. This type of electro-optic medium is typically bistable.

Another type of electro-optic display uses an electrochromic medium, for example an electrochromic medium in the form of a nanochromic film comprising an electrode formed at least in part from a semi-conducting metal oxide and a plurality of dye molecules capable of reversible color change attached to the electrode; see, for example O'Regan, B., et al., Nature 1991, 353, 737; and Wood, D., Information Display, 18(3), 24 (March 2002). See also Bach, U., et al., Adv. Mater., 2002, 14(11), 845. Nanochromic films of this type are also described, for example, in U.S. Pat. Nos. 6,301,038; 6,870,657; and 6,950,220. This type of medium is also typically bistable.

Another type of electro-optic display is an electro-wetting display developed by Philips and described in Hayes, R. A., et al., "Video-Speed Electronic Paper Based on Electrowetting", Nature, 425, 383-385 (2003). It is shown in copending application Ser. No. 10/711,802, filed Oct. 6, 2004 (Publication No. 2005/0151709), that such electro-wetting displays can be made bistable.

Another type of electro-optic display, which has been the subject of intense research and development for a number of years, is the particle-based electrophoretic display, in which a plurality of charged particles move through a fluid under the influence of an electric field. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

As noted above, electrophoretic media require the presence of a fluid. In most prior art electrophoretic media, this fluid is a liquid, but electrophoretic media can be produced using gaseous fluids; see, for example, Kitamura, T., et al., "Electrical toner movement for electronic paper-like display", IDW Japan, 2001, Paper HCS1-1, and Yamaguchi, Y., et al., "Toner display using insulative particles charged triboelectrically", IDW Japan, 2001, Paper AMD4-4). See also U.S. Patent Publication Nos. 2005/0259068, 2006/0087479, 2006/0087489, 2006/0087718, 2006/0209008, 2006/0214906, 2006/0231401, 2006/0238488, 2006/0263927 and U.S. Pat. Nos. 7,321,459 and 7,236,291. Such gas-based electrophoretic media appear to be susceptible to the same types of problems due to particle settling as liquid-based electrophoretic media, when the media are used in an orientation which permits such settling, for example in a sign where the medium is disposed in a vertical plane. Indeed, particle settling appears to be a more serious problem in gas-based electrophoretic media than in liquid-based ones, since the lower viscosity of gaseous suspending fluids as compared with liquid ones allows more rapid settling of the electrophoretic particles.

Numerous patents and applications assigned to or in the names of the Massachusetts Institute of Technology (MIT) and E Ink Corporation have recently been published describing encapsulated electrophoretic media. Such encapsulated media comprise numerous small capsules, each of which itself comprises an internal phase containing electrophoretically-mobile particles suspended in a liquid suspending medium, and a capsule wall surrounding the internal phase. Typically, the capsules are themselves held within a polymeric binder to form a coherent layer positioned between two electrodes. Encapsulated media of this type are described, for example, in U.S. Pat. Nos. 5,930,026; 5,961,804; 6,017,584; 6,067,185; 6,118,426; 6,120,588; 6,120,839; 6,124,851; 6,130,773; 6,130,774; 6,172,798; 6,177,921; 6,232,950; 6,249,271; 6,252,564; 6,262,706; 6,262,833; 6,300,932; 6,312,304; 6,312,971; 6,323,989; 6,327,072; 6,376,828; 6,377,387; 6,392,785; 6,392,786; 6,413,790; 6,422,687; 6,445,374; 6,445,489; 6,459,418; 6,473,072; 6,480,182; 6,498,114; 6,504,524; 6,506,438; 6,512,354; 6,515,649; 6,518,949; 6,521,489; 6,531,997; 6,535,197; 6,538,801; 6,545,291; 6,580,545; 6,639,578; 6,652,075; 6,657,772; 6,664,944; 6,680,725; 6,683,333; 6,704,133; 6,710,540; 6,721,083; 6,724,519; 6,727,881; 6,738,050; 6,750,473; 6,753,999; 6,816,147; 6,819,471; 6,822,782; 6,825,068; 6,825,829; 6,825,970; 6,831,769; 6,839,158; 6,842,167; 6,842,279; 6,842,657; 6,864,875; 6,865,010; 6,866,760; 6,870,661; 6,900,851; 6,922,276; 6,950,200; 6,958,848; 6,967,640; 6,982,178; 6,987,603; 6,995,550; 7,002,728; 7,012,600; 7,012,735; 7,023,420; 7,030,412; 7,030,854; 7,034,783; 7,038,655; 7,061,663; 7,071,913; 7,075,502; 7,075,703; 7,079,305; 7,106,296; 7,109,968; 7,110,163; 7,110,164; 7,116,318; 7,116,466; 7,119,759; 7,119,772; 7,148,128; 7,167,155; 7,170,670; 7,173,752; 7,176,880; 7,180,649; 7,190,008; 7,193,625; 7,202,847; 7,202,991; 7,206,119; 7,223,672; 7,230,750; 7,230,751; 7,236,790; 7,236,792; 7,242,513; 7,247,379; 7,256,766; 7,259,744; 7,280,094; 7,304,634; 7,304,787; 7,312,784; 7,312,794; 7,312,916; 7,237,511; 7,339,715; 7,349,148; 7,352,353; 7,365,394; and 7,365,733; and U.S. Patent Applications Publication Nos. 2002/0060321; 2002/0090980; 2003/0102858; 2003/0151702; 2003/0222315; 2004/0105036; 2004/0112750; 2004/0119681; 2004/0155857; 2004/0180476; 2004/0190114; 2004/0257635; 2004/0263947; 2005/0000813; 2005/0007336; 2005/0012980; 2005/0018273; 2005/0024353; 2005/0062714; 2005/0099672; 2005/0122284; 2005/0122306; 2005/0122563; 2005/0134554; 2005/0151709; 2005/0152018; 2005/0156340; 2005/0179642; 2005/0190137; 2005/0212747; 2005/0253777; 2005/0280626; 2006/0007527; 2006/0038772; 2006/0139308; 2006/0139310; 2006/0139311; 2006/0176267; 2006/0181492; 2006/0181504; 2006/0194619; 2006/0197737; 2006/0197738; 2006/0202949; 2006/0223282; 2006/0232531; 2006/0245038; 2006/0262060; 2006/0279527; 2006/0291034; 2007/0035532; 2007/0035808; 2007/0052757; 2007/0057908; 2007/0069247; 2007/0085818; 2007/0091417; 2007/0091418; 2007/0109219; 2007/0128352; 2007/0146310; 2007/0152956; 2007/0153361; 2007/0200795; 2007/0200874; 2007/0201124; 2007/0207560; 2007/0211002; 2007/0211331; 2007/0223079; 2007/0247697; 2007/0285385; 2007/0286975; 2007/0286975; 2008/0013155; 2008/0013156; 2008/0023332; 2008/0024429; 2008/0024482; 2008/0030832; 2008/0043318; 2008/0048969; 2008/0048970; 2008/0054879; 2008/0057252; and 2008/

0074730; and International Applications Publication Nos. WO 00/38000; WO 00/36560; WO 00/67110; and WO 01/07961; and European Patents Nos. 1,099,207 B1; and 1,145,072 B1.

Many of the aforementioned patents and applications recognize that the walls surrounding the discrete microcapsules in an encapsulated electrophoretic medium could be replaced by a continuous phase, thus producing a so-called polymer-dispersed electrophoretic display, in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned U.S. Pat. No. 6,866,760. Accordingly, for purposes of the present application, such polymer-dispersed electrophoretic media are regarded as sub-species of encapsulated electrophoretic media.

An encapsulated electrophoretic display typically does not suffer from the clustering and settling failure mode of traditional electrophoretic devices and provides further advantages, such as the ability to print or coat the display on a wide variety of flexible and rigid substrates. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; ink jet printing processes; and other similar techniques.) Thus, the resulting display can be flexible. Further, because the display medium can be printed (using a variety of methods), the display itself can be made inexpensively.

A related type of electrophoretic display is a so-called "microcell electrophoretic display". In a microcell electrophoretic display, the charged particles and the fluid are not encapsulated within microcapsules but instead are retained within a plurality of cavities formed within a carrier medium, typically a polymeric film. See, for example, U.S. Pat. Nos. 6,672,921 and 6,788,449, both assigned to Sipix Imaging, Inc.

Although electrophoretic media are often opaque (since, for example, in many electrophoretic media, the particles substantially block transmission of visible light through the display) and operate in a reflective mode, many electrophoretic displays can be made to operate in a so-called "shutter mode" in which one display state is substantially opaque and one is light-transmissive. See, for example, the aforementioned U.S. Pat. Nos. 6,130,774 and 6,172,798, and U.S. Pat. Nos. 5,872,552; 6,144,361; 6,271,823; 6,225,971; and 6,184,856. Dielectrophoretic displays, which are similar to electrophoretic displays but rely upon variations in electric field strength, can operate in a similar mode; see U.S. Pat. No. 4,418,346. Other types of electro-optic displays may also be capable of operating in shutter mode.

Other types of electro-optic materials may also be used in the present invention.

The bistable or multi-stable behavior of particle-based electrophoretic displays, and other electro-optic displays displaying similar behavior (such displays may hereinafter for convenience be referred to as "impulse driven displays"), is in marked contrast to that of conventional (non-bistable) liquid crystal ("LC") displays. Twisted nematic liquid crystals are not bi- or multi-stable but act as voltage transducers, so that applying a given electric field to a pixel of such a display produces a specific gray level at the pixel, regardless of the gray level previously present at the pixel. Furthermore, LC displays are only driven in one direction (from non-transmissive or "dark" to transmissive or "light"), the reverse transition from a lighter state to a darker one being effected by reducing or eliminating the electric field. Finally, the gray level of a pixel of an LC display is not sensitive to the polarity of the electric field, only to its magnitude, and indeed for technical reasons commercial LC displays usually reverse the polarity of the driving field at frequent intervals. In contrast, bistable electro-optic displays act, to a first approximation, as impulse transducers, so that the final state of a pixel depends not only upon the electric field applied and the time for which this field is applied, but also upon the state of the pixel prior to the application of the electric field.

Whether or not the electro-optic medium used is bistable, to obtain a high-resolution display, individual pixels of a display must be addressable without interference from adjacent pixels. One way to achieve this objective is to provide an array of non-linear elements, such as transistors or diodes, with at least one non-linear element associated with each pixel, to produce an "active matrix" display. An addressing or pixel electrode, which addresses one pixel, is connected to an appropriate voltage source through the associated non-linear element. Typically, when the non-linear element is a transistor, the pixel electrode is connected to the drain of the transistor, and this arrangement will be assumed in the following description, although it is essentially arbitrary and the pixel electrode could be connected to the source of the transistor. Conventionally, in high resolution arrays, the pixels are arranged in a two-dimensional array of rows and columns, such that any specific pixel is uniquely defined by the intersection of one specified row and one specified column. The sources of all the transistors in each column are connected to a single column electrode, while the gates of all the transistors in each row are connected to a single row electrode; again the assignment of sources to rows and gates to columns is conventional but essentially arbitrary, and could be reversed if desired. The row electrodes are connected to a row driver, which essentially ensures that at any given moment only one row is selected, i.e., that there is applied to the selected row electrode a voltage such as to ensure that all the transistors in the selected row are conductive, while there is applied to all other rows a voltage such as to ensure that all the transistors in these non-selected rows remain non-conductive. The column electrodes are connected to column drivers, which place upon the various column electrodes voltages selected to drive the pixels in the selected row to their desired optical states. (The aforementioned voltages are relative to a common front electrode which is conventionally provided on the opposed side of the electro-optic medium from the non-linear array and extends across the whole display.) After a pre-selected interval known as the "line address time" the selected row is deselected, the next row is selected, and the voltages on the column drivers are changed so that the next line of the display is written. This process is repeated so that the entire display is written in a row-by-row manner.

Typically, until now, electrophoretic and other bistable displays have an update time of the order of hundreds of milliseconds so that it has been assumed that such displays are confined to essentially static images and are not capable of displaying video. Advances have recently been made in reducing the impulse needed to switch electrophoretic displays; see, for example, Whitesides, T., et al. "Towards Video-rate Microencapsulated Dual-Particle Electrophoretic Displays", SID 04 Digest 133 (2004). Such reduced impulse may be used to reduce switching time (the time required for a pixel of a display to switch from one of its extreme optical states to the other) or the operating voltage of electrophoretic displays. Switching time and operating voltage are of course inter-related in that increasing the drive voltage will decrease switching time. However, even the aforementioned paper only claims that near video-rates can be achieved, and the paper is only discussing gray scale displays. Achieving acceptable video on a color display is considerably more difficult. In a gray scale display, it may be possible to tolerate not driving an electro-optic medium completely to its extreme optical states in the "black" and "white" areas of the display; such incomplete driving reduces the contrast ratio of the display but may still produce an acceptable picture. However, in the case of a reflective color display, in which only part of the area of the display can display each of the primary colors, it is much less easy to tolerate incomplete driving of the electro-optic medium to its extreme optical states, since such incomplete driving affects not only the contrast ratio of the display but also its color saturation. Accordingly, it has hitherto appeared that high quality video, and especially high quality color video, is not presently possible on bistable electro-optic displays.

SUMMARY OF THE INVENTION

In one aspect, this invention provides a bistable electro-optic display arranged to display video at a frame rate of from about 10 to about 20 frames per second; the frame rate may be, for example, from about 13 to about 20 frames per second.

Such a bistable electro-optic display may make use of any of the types of bistable electro-optic media described above. Thus, for example, the display may comprise a rotating bichromal member or electrochromic material. Alternatively, the display may comprise an electrophoretic material, which itself comprises a plurality of electrically charged particles disposed in a fluid and capable of moving through the fluid under the influence of an electric field. The electrically charged particles and the fluid may be confined within a plurality of capsules or microcells. Alternatively, the electrically charged particles and the fluid may be present as a plurality of discrete droplets surrounded by a continuous phase comprising a polymeric material. The fluid may be liquid or gaseous.

In another aspect, this invention provides a method of driving an electro-optic display, the method comprising driving the display at a frame rate of from about 10 to about 20 frames per second, wherein the electro-optic medium used in the display, when being driven, changes its electro-optic properties continuously throughout the driving of each frame. The electro-optic medium, when driven, may change its electro-optic properties substantially linearly throughout the driving of each frame. The frame rate of the display may be from about 13 to about 20 frames per second.

Such a bistable electro-optic display may make use of any of the types of bistable electro-optic media described above.

In another aspect, this invention provides a method of driving an electro-optic display comprising an electro-optic medium wherein the frame period (the period between the supply of successive images to the video display) is from about 50 to about 200 per cent of the switching time of the electro-optic medium (the time required to switch it from one extreme optical state to the other). The frame period may be from about 75 to about 150 per cent of the switching time. The electro-optic medium may or may not be bistable.

Such a bistable electro-optic display may make use of any of the types of bistable electro-optic media described above.

The displays of the present invention may be used in any application in which prior art electro-optic displays have been used. Thus, for example, the present displays may be used in electronic book readers, portable computers, tablet computers, cellular telephones, smart cards, signs, watches, shelf labels and flash drives.

DETAILED DESCRIPTION

Conventional video rate displays using non-bistable media, such as the phosphors on cathode ray tubes and conventional liquid crystal displays, require frame rates in excess of about 25 frames per second (fps) to provide acceptable video quality. (Video display at 15 fps is common on internet videos but results in a noticeable lack of video quality.) It has now very surprisingly been found that bistable, and certain other, electro-optic displays can produce good quality images at frame rates substantially below 25 fps, and in the range of about 10 to about 20 fps, preferably about 13 to about 20 fps. Experienced observers have determined that encapsulated electrophoretic displays running at 15 fps can produce video quality which appears substantially equal to that produced by non-bistable displays running at about 30 fps.

Although the reasons for this unexpectedly high video quality at low frame rates are not at present entirely understood (and the invention is not limited by any particular explanation for the phenomenon), it appears that part of the explanation lies in the manner in which the persistent image on a bistable display assists the eye in "blending" successive images to create the illusion of motion. All video displays rely upon the ability of the eye to blend a series of still images to create the illusion of motion. However, many types of video display actually introduce transient intervening "images" which hinder the blending process. For example, a motion film display using a mechanical film projector actually places a first static image on the screen, then displays a blank screen for a very short period as the projector advances the film to the next frame, and thereafter displays a second static image.

Other types of video displays (for example, cathode ray tubes and non-bistable liquid crystals) do not introduce an intermediate "image" but change an image by writing a first image very rapidly on the display during a small proportion of the frame period, and then allowing this first image to undergo a substantial amount of fading during the remaining part of the frame period before a second image is written. This type of behavior is illustrated in a highly schematic manner in FIG. 1 of the accompanying drawings.

Figure 1:
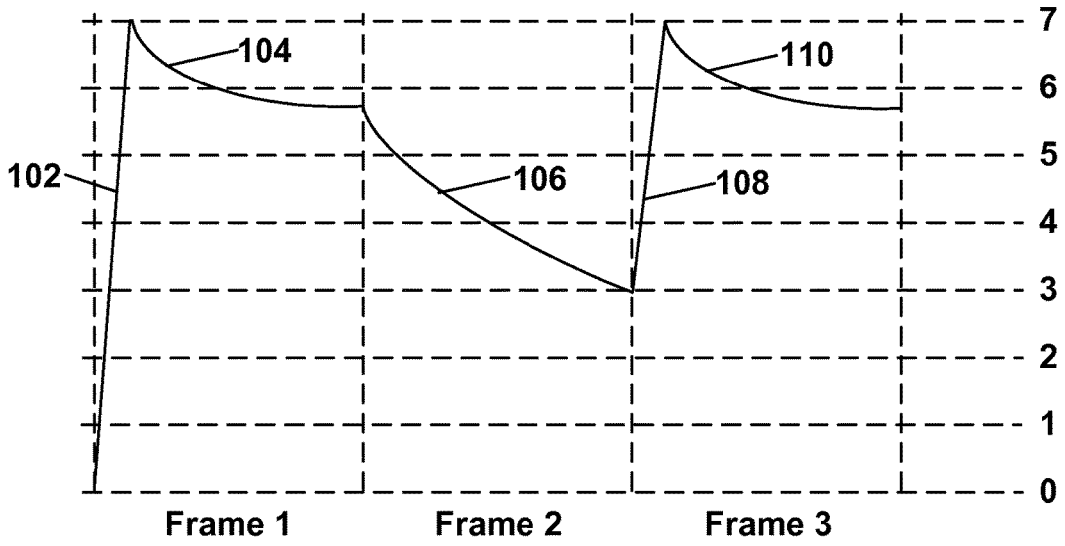
Fig. 1 (Prior Art)
FIG. 1 of the accompanying drawings is a graph showing schematically how the optical properties of a single pixel of a prior art liquid crystal display vary with time during a series of transitions in a video.

FIG. 1 illustrates schematically the variation with time of the gray levels of a single pixel of an 8 gray level liquid crystal display, the gray levels being designated 0 (black) to 7 (white). (In practice, commercial liquid crystal displays normally have a considerably larger number of gray levels.) In a first frame, the liquid crystal is driven from black (gray level 0, corresponding to a non-transmissive liquid crystal material) to white (gray level 7, corresponding to a transmissive liquid crystal material). As shown at 102 in FIG. 1, typically the liquid crystal material undergoes a very rapid transition from gray level 0 to gray level 7, and thereafter there is, over the remaining major portion of the frame period, a gradual relaxation to (say) about gray level 6, as indicated at 104 in FIG. 1.

In the second frame, it is desired to change the pixel to gray level 3. Since liquid crystals are only driven in one direction, from dark to light, the change from gray level 6 to gray level 3 is effected by reducing the electric field across the liquid crystal to a suitably low value, and allowing the liquid crystal to relax to the desired gray level, as indicated at 106 in FIG. 1.

In the third frame, it is desired to return the pixel to gray level 7. The resultant 3-7 gray level transition is generally similar to the 0-7 gray level transition, with a very rapid initial increase in gray level, indicated at 108, followed by a gradual relaxation to about gray level 6, as indicated at 110.

Many types of prior art display, for example cathode ray tubes using phosphors, use a similar rewriting process in which the rewriting occupies only a small part of each frame period. The increase in emission from a phosphor struck by an electron beam may occur in less than 1 millisecond, while modern non-bistable liquid crystals may be rewritten in about 2 to 5 milliseconds. Since the pixel remains in the same optical state throughout the greater part of the frame, subject of course to any fading which occurs between rewrites, the effect is similar to that achieved with a mechanical motion picture projector, in which a series of fixed images are displayed successively, with no blending between successive images.

Furthermore, the relaxation or fading illustrated at 104 and 110 causes its own problems. Since a new image is normally written line by line by scanning across the display, each line in turn goes from being part of the darkest portion of the display to being the brightest portion immediately after rewriting. This continual change in brightness of the various lines of the display is perceived by the human eye as a "flicker" on the display. In many cases, annoying flicker can only be reduced to an acceptable level by using a frame rate higher than that required to give the illusion of motion. For example, television broadcasts (which were originally designed to be watched on cathode ray tubes, although several other technologies are now in use) use a frame rate of 30 fps but also use an interlacing technique whereby only alternate lines on the display are rewritten on each scan, with the second half of the lines being rewritten on the next scan, so that the display shows 60 "half-frames" per second. Liquid crystal computer monitors typically have to be driven at frame rates of at least 60 fps (non-interlaced) to avoid flicker, although 30 fps is normally sufficient to give the illusion of motion.

Figure 2:
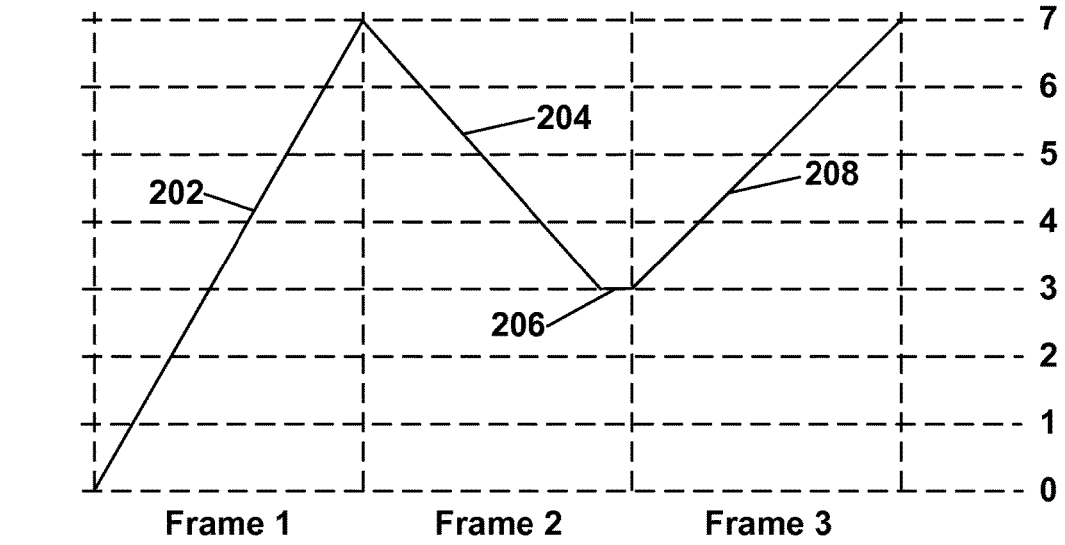
FIG. 2 is a graph similar to FIG. 1 but showing the optical properties of a pixel of an electrophoretic display of the present invention undergoing a similar series of transitions in a video.

FIG. 2 of the accompanying drawings illustrates the changes in optical state of an electrophoretic medium undergoing the same 0-7-3-7 optical transitions as in FIG. 1. (Although FIGS. 1 and 2 both show three frame periods, it is not intended to imply that these frame periods are of the same duration in both cases. Typically, the frame period for writing an electrophoretic display is substantially longer than for rewriting a liquid crystal display.) Note that, as shown at 202 in FIG. 2, during the 0-7 gray level transition in the first frame period, the optical state of the pixel changes linearly during the entire frame period, so that gray level 7 is only reached at the end of the frame period and there is no opportunity for later fading, which in any case would not occur since the display is bistable. (FIG. 2 is somewhat over-simplified. The change in optical state of an electrophoretic medium is not necessarily linear with time. Also, in practice to keep the controller simple and inexpensive, as described in several of the patents and applications referred to in the "Reference to Related Applications" section above, the controller may only be able to apply a single drive voltage, which may be turned off and on repeatedly during a single transition, so that the change in optical state during a transition may be jerkier than illustrated in FIG. 2.)

In the second frame, a 7-3 gray level transition is effected. Unlike a liquid crystal medium, where a transition from a light state to a darker state is effected simply by relaxation of the liquid crystal medium, a bistable electrophoretic medium needs to be driven in both directions (i.e., in both black-going and white-going transitions), and hence, as illustrated at 204 in FIG. 2, the 7-3 transition is generally similar to the earlier 0-7 transition in that the optical state changes essentially linearly during a major proportion of the frame period. However, FIG. 2 does illustrate the point that, in some cases, the transition may not occupy the whole of the frame period and there may be a short period, as shown at 206, in which the medium is not being driven and simply remains in substantially the same optical state by virtue of its bistability.

Finally, in the third frame period a 3-7 gray level transition is effected. As shown at 208 in FIG. 2, this transition is substantially similar to the 0-7 transition effected in the first frame period, and the optical state of the medium simply increases smoothly with time until gray level 7 is reached at the end of the frame period.

Comparing FIG. 2 with FIG. 1 it will be seen that the transitions in FIG. 2 lack the abrupt changes in optical state followed by relatively slow fading characteristic of the first and third transitions shown in FIG. 1; instead, a pixel undergoing changes, as illustrated in FIG. 2 undergoes a series of smooth, largely uninterrupted changes in optical state. Furthermore, as discussed in several of the patents and applications referred to in the "Reference to Related Applications" section above, bistable displays can be driven by rewriting only the pixels which change between successive images, so that in many cases most of the pixels of an image will not change as the display is rewritten. It is believed that this type of smooth, continuous "flow" from one image to the succeeding image is more successful in creating to the eye an impression of smooth motion, as compared with the display of unchanging images throughout most if not substantially all of each frame period.

Thus a video display of the present invention using a bistable electro-optic medium does not write any intermediate image on the display; the first image simply persists until the second image is written over it. Furthermore, there is no appreciable fading of a bistable display between successive images, so bistable displays are essentially free from any flicker effects.

Although FIG. 2 has been described above with reference to driving an electrophoretic medium, it will be apparent to those skilled in the technology of electro-optic displays that the advantages resulting from the smooth transitions shown in FIG. 2 are dependent upon the smoothness of the transitions and not upon the nature of the specific electro-optic medium used. Furthermore, the transitions shown in FIG. 2 do not require that the electro-optic medium be bistable in the normal sense of that term. Even if undriven periods such as that indicated at 206 in FIG. 2 are present (and it may often be possible to eliminate such undriven periods by careful control of the waveforms used to drive the display), such undriven periods have a duration of only a fraction of a frame period (say of the order of 25 milliseconds), and provided there is no substantial change in the optical state of the medium during such brief undriven periods, the advantages of the invention are still obtained. Thus, in a second aspect this invention provides a method of driving an electro-optic display at a frame rate of about 10 to about 20 frames per second, wherein the electro-optic medium used in the display, when being driven, changes its electro-optic properties continuously throughout the driving of each frame. For example, since an organic light emitting diode (OLED) responds essentially instantaneously (for practical purposes) to changes in the applied voltage, by careful control of the applied voltage against time curve, an OLED could be caused to mimic the behavior of the electrophoretic display shown in FIG. 2.

It will readily be apparent that, to produce the type of smooth transitions illustrated in FIG. 2, in which the change in optical density continues throughout the frame period, that there should be a controlled relationship between the drive voltage used in the display, the switching speed of the display medium at this drive voltage, and the frame period. It has been found desirable to use a drive voltage such that the frame period is from about 50 to about 200 per cent of the switching time of the electro-optic medium. Preferably, the frame period is from about 75 to about 150 per cent of the switching time. With a frame rate similar to the switching time, at least the pixels which differ between successive images are changing their appearance throughout the frame period, and, as already noted, it is believed that this type of smooth, continuous "flow" from one image to the succeeding image is more successful in creating to the eye an impression of smooth motion, as compared with the display of unchanging images throughout most if not substantially all of each frame period. If a bistable electro-optic display is driven with a voltage-modulated driver, it may be advantageous to adjust the driving voltage used for each transition such that each transition required at least about one-half of the frame period to be completed.

The video displays of the present invention also have a further advantage when it is desired to record the output from the display using a video camera or similar device. As is well known to those skilled in the art of video photography, when attempting to photograph a cathode ray tube or non-bistable liquid crystal video display, it is necessary to carefully synchronize the frame rate of the camera with that of the display or noticeable video artifacts, often in the form of dark bands which slide up or down the display, will adversely affect the quality of the recording. These dark bands are largely due to the aforementioned fading of the display between successive rewritings. Since the electro-optic displays of the present invention do not suffer significantly from such fading, the output from such a display can be recorded without synchronizing the frame rate of the camera with that of the display and without producing noticeable video artifacts.

The video electro-optic displays of the present invention share most of the advantages of prior art electro-optic displays intended for displaying static images. For example, the video displays of the present invention typically have lower power consumption than prior art video displays, since it is only necessary to rewrite the pixels which change between successive images. (Rewriting of unchanging pixels at long intervals of at least seconds may be needed to cope with slow fading of the displays, but the energy used in rewriting at such long intervals is much less than that required in displays, such as those based on non-bistable liquid crystals, which must be rewritten continuously.) Furthermore, freezing individual frames on a bistable display of the present invention is much simpler than on a prior art display, since on the bistable display one can simply stop rewriting the display leaving the desired frozen image in place.

The displays of the present invention may be used in any application in which prior art video displays have been used. Thus, for example, the present displays may be used in electronic book readers, portable computers, tablet computers, cellular telephones, smart cards, signs, watches, shelf labels and flash drives.

Numerous changes and modifications can be made in the preferred embodiments of the present invention already described without departing from the scope of the invention. Accordingly, the foregoing description is to be construed in an illustrative and not in a limitative sense.

The invention claimed is:

1. A method of driving a bistable electro-optic display comprising a bistable electro-optic medium wherein a frame period is from about 50 to about 200 percent of the switching time of the bistable electro-optic medium, wherein the bistable electro-optic medium undergoes a series of smooth, largely uninterrupted changes in optical state between successive images.

2. A method of driving a bistable electro-optic display comprising a bistable electro-optic medium wherein a frame period is from about 75 to about 150 percent of the switching time of the bistable electro-optic medium, wherein the bistable electro-optic medium undergoes a series of smooth, largely uninterrupted changes in optical state between successive images.

3. A method of driving a bistable electro-optic display comprising a bistable electro-optic medium wherein a frame period is from about 50 to about 200 percent of the switching time of the bistable electro-optic medium, and wherein the bistable electro-optic medium undergoes a series of smooth, largely uninterrupted changes in optical state between successive images and comprises a rotating bichromal member or electrochromic medium.

4. A method of driving a bistable electro-optic display comprising a bistable electro-optic medium wherein a frame period is from about 50 to about 200 percent of the switching time of the bistable electro-optic medium, and wherein the bistable electro-optic medium undergoes a series of smooth, largely uninterrupted changes in optical state between successive images and comprises an electrophoretic medium, which itself comprises a plurality of electrically charged particles disposed in a fluid and capable of moving through the fluid under the influence of an electric field.

5. A method according to claim 4 wherein the electrically charged particles and the fluid are confined within a plurality of capsules or microcells.

6. A method according to claim 4 wherein the electrically charged particles and the fluid are present as a plurality of discrete droplets surrounded by a continuous phase comprising a polymeric material.

7. A method according to claim 4 wherein the fluid is gaseous.

* * * * *